United States Patent [19]

Manfredi

[11] Patent Number: 4,527,574

[45] Date of Patent: Jul. 9, 1985

[54] PORTABLE DENTAL KIT

[76] Inventor: John A. Manfredi, 309 Nelson St., Brantford, Ontario, Canada, N3S 4E2

[21] Appl. No.: 478,795

[22] Filed: Mar. 25, 1983

[51] Int. Cl.[3] ..... A45D 44/18

[52] U.S. Cl. ..... 132/84 B; 132/84 R

[58] Field of Search ..... 132/84 R, 84 B, 84 D

[56] References Cited

U.S. PATENT DOCUMENTS

| | | | |
|---|---|---|---|
| 1,716,617 | 6/1929 | Brockelsby | 132/84 B |
| 2,634,025 | 4/1953 | Hausner | 132/84 R |
| 2,699,889 | 1/1955 | Johnson | 132/84 R |
| 4,294,269 | 10/1981 | Kyte | 132/84 B |

*Primary Examiner*—Gregory E. McNeill

*Attorney, Agent, or Firm*—George A. Rolston

[57] ABSTRACT

A portable dental kit having, a handle having two ends, a toothbrush attached at one end of the handle, the other end of the handle being open, the handle defining a hollow interior, removable cover means for the toothbrush, toothpaste container shaped and adapted to be inserted into the hollow handle, through the open end, such container having a flexible side wall, and a dispensing opening and closure cap at one end, and at the other end, there being a filling member inserted into the side wall, a filling bore on the interior of the member, and a closure cap removably attachable to the member, the side wall of the container being of reduced diameter with respect to the diameter of the interior of the hollow handle, and there being an enlarged diameter portion at the other end of the container, and a clamping collar encircling the flexible side wall around a portion of filling member and fastening the two together.

6 Claims, 7 Drawing Figures

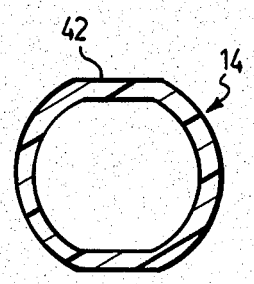
FIG. 3.
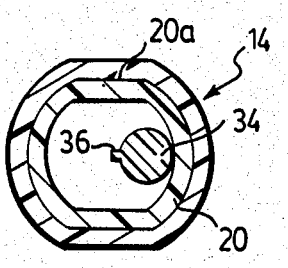
FIG. 4.
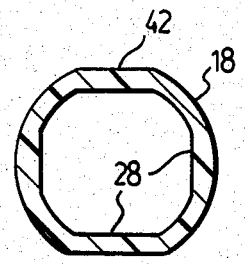
FIG. 5.
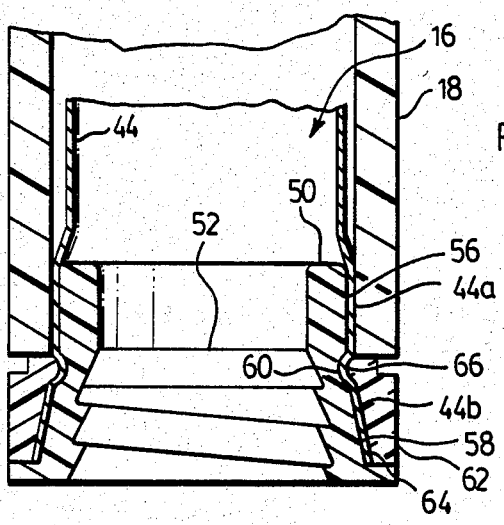
FIG. 6.
FIG. 7.
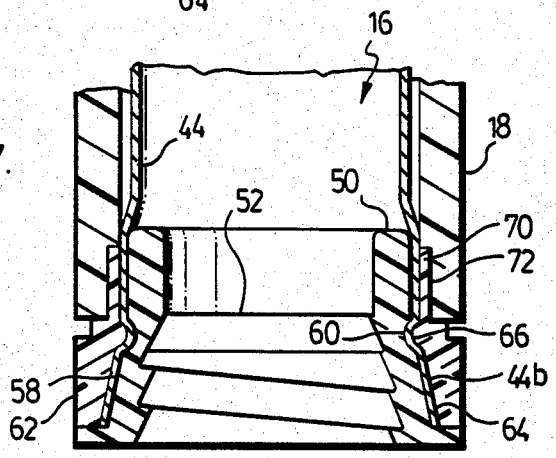

PORTABLE DENTAL KIT

This application is a continuation-in-part of application Ser. No. 304,881, Portable Dental Kit, filed Sept. 23, 1981.

The invention relates to a portable dental kit which can be carried on the person, or in a handbag, and provides a toothbrush, and a container containing toothpaste.

Numerous attempts have been made in the past to provide a portable dental kit which enables the user to clean their teeth when away from home. Most of such kits have failed for a variety of reasons. In the majority of cases, the problems have arisen in the design and construction of the container for toothpaste. This is usually stored in a hollow handle, and on one end of the handle a toothbrush is attached. The container is required to be inserted and removed from the hollow handle, and must be capable of being secured in the hollow handle for carrying, when not in use.

It must be born in mind that in many cases such dental kits will not be in regular use, and accordingly, it may not be desirable to store toothpaste in such container for any length of time since it will tend to dry out.

If it were possible to construct such a toothpaste container in a conventional manner, using a flexible walled collapsible toothpaste tube of a suitable size, then the problem of storage would not arise. In the conventional toothpaste tube, as toothpaste is squeezed out of the tube, the tube simply collapses. Consequently no air is admitted to the tube and the toothpaste does not dry out. However, it has been found practical to use such collapsible toothpaste tubes in portable dental kits. The reason for this is that the recess in the hollow handle into which the toothpaste is usually inserted is relatively confined, and it is not possible to insert an irregular shaped object such as a squeezed toothpaste tube into it.

This particular problem was overcome in a highly satisfactory manner in the portable dental hygiene kit disclosed in Canadian Letters Patent No. 1,056,111. In that device, the toothpaste tube consisted of a cylindrical tube of flexible material having a filling opening and cap at its base, and having an ejection opening and cap at its top end. It was thus possible for a user to fill the tube with toothpaste before, for example going on a trip, and then to use the kit as long as was required. On his return home, he could then simply remove the toothpaste tube, open both ends and clean it out so that it was then ready for re-use.

This system had the added advantage that the user could use his favourite brand of toothpaste, and simply re-fill it in the house as required. In addition, it was not necessary for drug stores, for example, to stock specially sized toothpaste tubes for use in the kits. Thus the kit was a more practical and marketable article from every point of view, and enjoyed considerable popularity. However, there were certain problems in the construction of the toothpaste container. Since the side walls of the container were flexible, so that toothpaste could be squeezed out, it was necessary to mold separate components for providing the filling opening at the base of the tube. These components then had to be attached to the tube in a separate operation. The components to be attached consisted of a generally annular filling member with a threaded interior, and a threaded filling cap for closing the opening in the member. In one form of attachment, the member was forced into the open end of the base of the flexible tube, and was then welded for example by sonic welding. However, the sonic welding attachment was not always reliable, and separation occurred in some cases. Attachment by adhesives, or chemical solvents was also found to be unsatisfactory. Another method of attachment was to bring the flexible tube, and the member into end abutting relation, without inserting the member into the tube, and then attempt to weld the two together. However, this again leads to manufacturing problems, and is relatively difficult to achieve with any degree of consistency.

Accordingly, the present invention seeks to provide a portable dental kit having an improved toothpaste container in which these various problems are overcome. With a view to providing these objectives, the invention provides a portable dental kit having a handle having two ends, with one end having a toothbrush attached thereto, and at the other end, having an opening, the handle being hollow, and having a removable cap over the toothbrush, which is releasably attachable to the handle, and having a toothpaste container shaped and adapted to be inserted into the hollow handle, through the open end, the toothpaste container having flexible side walls, and a dispensing opening and closure cap at one end, and at the other end, having a filling member inserted into the tube, the member having a threaded bore, and a closure cap removably attached to the member, and a clamping collar encircling said tube, around said filling member, and holding the same in engagement on said member.

It is a further and related objective of the invention to provide a member having an exterior surface which is shaped to frictionally engage the interior of the tube, and thereby increase the clamping effect of the clamping collar.

It is a further and related objective of the invention to provide complementary mating formations on the filling member and on the clamping collar, designed to deform the tube, and provide a locking action preventing removal of the clamping collar from the tube.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

FIG. 3 is a section along the line 3—3 of FIG. 2;

FIG. 4 is a section along the line 4—4 of FIG. 2;

FIG. 5 is a section along line 5—5 of FIG. 2;

FIG. 6 is a greatly enlarged longitudinal section of a portion of FIG. 1, and, FIG. 7 shows a further modification of the invention.

Figure 1:
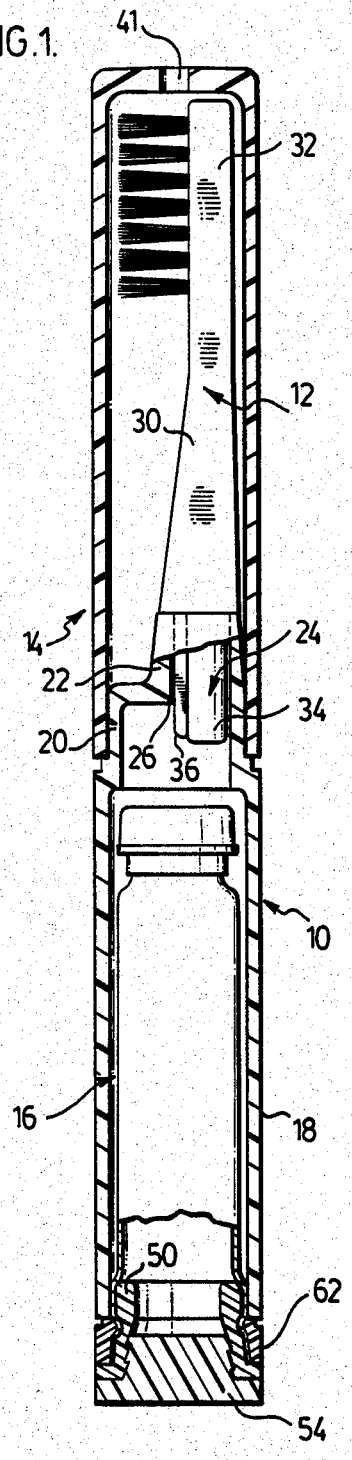
FIG. 1 is a longitudinal section of the portable dental kit according to the invention.
Figure 2:
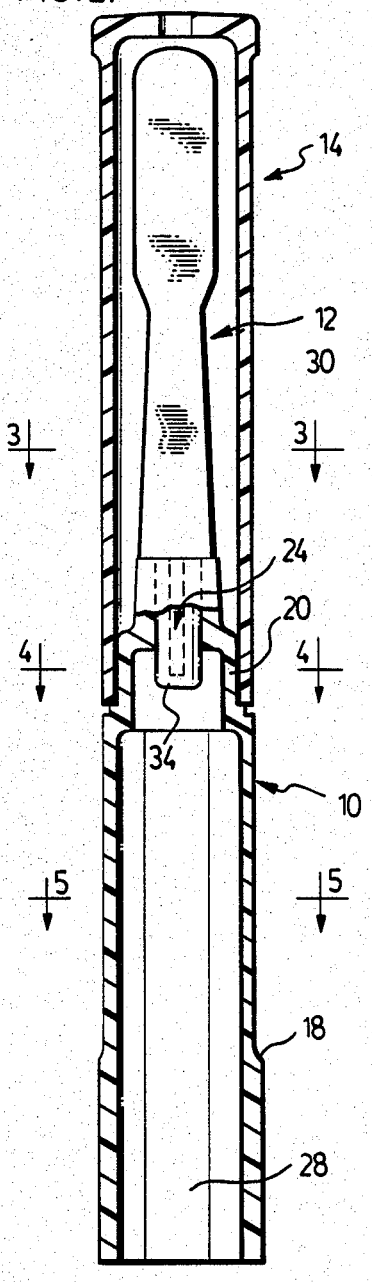
FIG. 2 is a longitudinal section of the kit of FIG. 1, rotated ninety degrees, without the container.

As shown in the drawings, this embodiment of the invention comprises a handle indicated generally as 10, a toothbrush attached thereto, indicated generally as 12, and end cap 14, and a toothpaste container 16. The handle 10 comprises a hollow partly cylindrical main body portion 18, and an integral reduced diameter neck 20. An attachment socket 22 extends forwardly of the neck 20, and has a central bore 24 therein having at least one axial groove 26. As shown, the main body 18, neck 20 and socket 22 are all formed integrally of a single piece of thermoplastic material, by injection molding techniques. The handle 18 defines a hollow interior, for the reception therein of the tube 16. The interior of the handle portion 18 is formed with four raised planar sections 28 running axially therealong along the interior, for reasons to be described below. The toothbrush 12 may be of any suitable design and comprises a rod portion 30, having a generally enlarged head 32 drilled to receive bristles therein, in the conventional manner. At the other end of rod 30, is a bayonet type stub fitting 36 extending therefrom axially aligned with the axis of the rod 30. Stub portion 34 has an axial ridge 36 on one side. Stub 34 and ridge 36 are designed to fit within the passageway 24 and groove 26 in socket portion 22 of handle 18. In this way, it is possible to provide replacement toothbrushes, as needed, without the need for discarding the whole kit.

The end cap 14 is formed of elongated partly cylindrical side walls 38, and an end wall 40, which is desireably provided with vent opening means 41, to permit free circulation of air around the toothbrush.

In order to provide a distinctive appearance, generally complementary flattened surfaces 42 are formed along the side walls 38 of end cap 14 and along the main body portion 18 of handle 10. These flattened portions also facilitate the application of labelling, by means such as hot stamping and the like. The use of such flattened portions in the end cap 14 produces an interior shape corresponding thereto, ie., having two opposed flattened surfaces, between the remainder of the wall 38 which is cylindrical. This in turn provides a means of locating the rotational position of the end cap 14 on the reduced neck portion 20. Neck portion 20 is therefore similarly provided with two flattened surfaces 20*a*, on opposite sides thereof, so as to mate with the flattened surfaces 42 of end cap 14. The toothpaste container 16 will be seen to comprise a generally elongated cylindrical side wall 44, formed of flexible somewhat resilient thermoplastic material. It has a rigid neck 46 of conventional design attached to one end, and defining a hollow passageway (not shown) through which toothpaste may be ejected. An end closure cap 48 is threadedly fastened on the neck 46. At the other of back end of the tubular wall 44, there is provided a rigid thermoplastic filling member 50, again defining an interior passageway threaded as at 52 to receive an end closure 54. Member 50 defines two distinct portions namely a generally cylindrical outer wall 56 and a generally frusto-conical flaired outer surface 58. Wall 56 has a diameter slightly greater than the interior diameter of the cylindrical tube 44 which distends a portion 44*a* of tube 44 and forms a tight fit within handle 18, by engaging the four flattened portions 28. Frusto-conical outer surface 58 is dimensioned to further distend a terminal portion 44*b* of the cylindrical tube 44 into a frusto-conical shape. A shallow annular groove 60 is formed in the outer portion of member 50, between the cylindrical wall 56 and a frusto-conical surface 58.

In order to retain the tubular body 44 on the member 50, clamping means are provided, in the form of the collar 62. Collar 62 has a generally cylindrical exterior surface, having a diameter corresponding to the outer diameter of the handle 18, and has an interior surface defining generally frusto-conical shape 64 corresponding to the frusto-conical shape 58 of member 50. In addition, it is provided with an annular rib 66 shaped to interfit with the groove 60. Rib 66 in fact deforms the wall 44 and forces it into the groove 60 and the frusto-conical surface 64 serves to clamp the terminal portion 44*b* of the tubular body 44 rightly against the frusto-conical surface 58 of the member 50. It will be noted that the tubular body 44 of the container 16 has a diameter which is less than the maximum interior diameter of the handle 18, and in fact corresponds more or less to the spacing between opposed flattened portions 28 therein. In this way, the handle 18 forms airways, between the flattened portions 28, through which air may be ejected upon the insertion of the container 16, thereby facilitating insertion and removal in use.

As stated, container 16 is retained within handle 18 by means of the enlarged diameter in the region of cylindrical portion 56 of member 50, which is dimensioned to make a good push fit in the handle.

It will thus be seen that by the use of the invention a traveler for example may first of all fill the container 16 by removing the end cap 54 and also by loosening or preferably removing the closure cap 48. The nozzle of a conventional tube of toothpaste (not shown) may then be inserted into the open bore within threads 52 and a suitable quantity of toothpaste ejected into the container 16. The caps 48 and 54 are then replaced in position. Preferably, cap 54 is replaced first so that any toothpaste lying within member 50 is displaced into the container 16, while the nozzle portion 46 is still open. In this way any possible overpressure within container 16 resulting from the displacement of toothpaste therein is avoided.

In use, the user will then simply remove the end cap 14, and withdraw the toothpaste container 16, and remove closure 48. He may then apply a suitable quantity of toothpaste to the toothbrush and then replace the cap 48 and re-insert the container 16 in the handle 10. Having cleaned his teeth, he may then replace the end cap 14.

Whenever necessary, he may remove caps 48 and 54 and clean out the container 16 and refill with further toothpaste as and when required.

The attachment of the tubular body 44 to the collar 50 is achieved in a particularly simple and effective manner by means of the invention without the requirement for special manufacturing techniques, or welding by means of heat, or ultrasonic vibration, which have proved to be difficult in the past.

In a modified form of the invention a reduced diameter friction sleeve 70 is formed integral with the collar 62 and enclosing the lower end of the tubular wall 44 (see FIG. 7).

The interior bore of the handle 10 is widened in diameter as at 72 to receive sleeve 70. This provides a more secure fit to hold the container in the handle.

It will, of course, be appreciated that suitable plastics should be selected for the various components, and in particular that the toothpaste container 16 should be capable of storing toothpaste of a variety of different types without reacting therewith.

The foregoing is a description of a preferred embodiment of the invention which is given here by way of example only. The invention is not to be taken as limited to any of the specific features as described, but comprehends all such variations thereof as come within the scope of the appended claims.

I claim:

1. A portable dental kit comprising;

a handle having two ends, and a toothbrush attached at one end of said handle, the other end of said handle being open, and said handle defining a hollow interior;

removable cover means for said toothbrush;

toothpaste container means shaped and adapted to be inserted into said hollow handle, through said open end, said container means having first and second ends and a flexible tubular side wall;

a dispensing opening and dispensing cap at a first end thereof;

a rigid filling member fitting at least partly into said tubular side wall at said second end of said container means, said filling member having an inner surface defining a filling passageway for insertion of toothpaste into said container means, and having an outer surface defining retention formations thereon engaging the interior of said tubular side wall;

threaded means on said filling member, and a filling cap removably attachable thereto for removably losing said filling passageway;

a clamping collar fitting around a portion of said flexible tubular side wall and said filling member, said collar gripping and deforming said tubular side wall and forcing same to conform to said retention formations on said filling member, thereby fastening said side wall to said filling member, said filling cap being separate from said clamping collar and being removable for filling of said container means through said filling passsageway in said filling member, and, said clamping collar having an exterior surface shaped to conform to the exterior of said handle.

2. A portable dental kit as claimed in claim 1 wherein said filling member has first a generally cylindrical outer portion, and a second frusto-conical tapered outer portion said retention formations being formed between said two outer portions.

3. A portable dental kit as claimed in claim 2 wherein said retention formations comprise an annular groove formed around said filling member between said cylindrical portion and said frusto-conical portion.

4. A portable dental kit as claimed in claim 2 wherein said clamping collar comprises a ring having a generally frusto-conical inner surface, and a cylindrical outer surface, corresponding in diameter to the diameter of said handle.

5. A portable dental kit as claimed in claim 4 wherein said ring has a generally annular rib on its inner surface, adjacent the narrow end of said frusto-conical surface, said ring being adapted to register with said groove and deform said side wall therebetween.

6. A portable dental kit as claimed in claim 1 including a sleeve portion on said collar, of reduced diameter relative thereto, and including complementary widened portion within said handle for receiving, said sleeve portion.

* * * * *